US009134060B2

(12) United States Patent
Seymour

(10) Patent No.: US 9,134,060 B2
(45) Date of Patent: Sep. 15, 2015

(54) ICE AND CHILLED WATER PRODUCING AND DISPENSING MACHINE

(75) Inventor: Kerry R. Seymour, Elko, GA (US)

(73) Assignee: KOOLER ICE, INC., Byron, GA (US)

( * ) Notice: Subject to any disclaimer, the term of this patent is extended or adjusted under 35 U.S.C. 154(b) by 869 days.

(21) Appl. No.: 13/326,022

(22) Filed: Dec. 14, 2011

(65) Prior Publication Data

US 2012/0186276 A1 Jul. 26, 2012

Related U.S. Application Data

(60) Provisional application No. 61/424,416, filed on Dec. 17, 2010.

(51) Int. Cl.
*F25C 5/00* (2006.01)

(52) U.S. Cl.
CPC . *F25C 5/002* (2013.01); *F25C 5/00* (2013.01); *F25C 2300/00* (2013.01); *F25C 2400/00* (2013.01)

(58) Field of Classification Search
CPC .... F25C 5/00; F25C 2300/00; F25C 2400/04; F25C 5/002
USPC ..... 62/66, 344
See application file for complete search history.

(56) References Cited

U.S. PATENT DOCUMENTS 2,234,425 A * 3/1941 Brady ..... 241/5
3,151,668 A * 10/1964 Zimmermann ..... 222/146.1
3,608,786 A 9/1971 Shelley et al.
3,807,193 A * 4/1974 McKenney et al. ..... 62/322
4,333,612 A 6/1982 Hayashi
4,338,794 A 7/1982 Haasis, Jr.
5,088,300 A 2/1992 Wessa
5,109,651 A * 5/1992 Stuart ..... 53/502
5,277,016 A * 1/1994 Williams et al. ..... 53/459
5,630,310 A 5/1997 Chadwell
6,093,312 A 7/2000 Boulter
6,112,539 A 9/2000 Colberg
6,266,945 B1 * 7/2001 Schroeder ..... 53/473
6,324,850 B1 * 12/2001 Davis ..... 62/3.64
6,561,691 B1 * 5/2003 McCann et al. ..... 366/299
6,904,946 B2 6/2005 James
6,932,124 B2 8/2005 Dalton et al.
7,207,156 B2 4/2007 Metzger
7,428,824 B1 9/2008 Malachowsky et al.
7,624,773 B2 12/2009 Maxwell (Continued)

OTHER PUBLICATIONS

International Search Report and Written Opinion for PCT/US2011/064963.

*Primary Examiner* — Ljiljana Ciric
*Assistant Examiner* — Alexis Cox
(74) *Attorney, Agent, or Firm* — McClure, Qualey & Rodack, LLP

(57) ABSTRACT

An ice producing and dispensing machine for delivering ice on demand to a consumer with a housing containing an ice maker having a discharge outlet for discharging ice. An ice bin is disposed below the ice maker having an open top for receiving ice from the ice maker and a bottom opening for discharging ice therefrom; a vertical tube is connected with the bottom opening for receiving discharged ice with an auger in the tube for driving the ice vertically in the tube; and a receiving chute connected with the tube for conveying the ice to the ice delivery outlet either in a bag or as free ice cubes. Melted water and ice chips from the ice production are recycled and used to cool the water that is fed to the ice maker.

12 Claims, 6 Drawing Sheets

(56) References Cited

U.S. PATENT DOCUMENTS

| | | | | |
|---|---|---|---|---|
| 2004/0079103 | A1 | 4/2004 | Hawkes et al. | |
| 2004/0216481 | A1 | 11/2004 | James et al. | |
| 2004/0231343 | A1* | 11/2004 | Fukumoto et al. | 62/66 |
| 2006/0207271 | A1 | 9/2006 | Elsom et al. | |
| 2007/0175235 | A1 | 8/2007 | Metzger | |
| 2009/0120126 | A1* | 5/2009 | Mew | 62/530 |
| 2009/0145158 | A1* | 6/2009 | Anselmino et al. | 62/344 |
| 2009/0165492 | A1* | 7/2009 | Wilson et al. | 62/344 |
| 2010/0293984 | A1* | 11/2010 | Adamski et al. | 62/344 |
| 2011/0061420 | A1* | 3/2011 | Anderson et al. | 62/389 |
| 2012/0111449 | A1* | 5/2012 | Hsu | 141/82 |
| 2013/0068422 | A1* | 3/2013 | Horowitz | 165/80.1 |
| 2014/0311168 | A1* | 10/2014 | Berge et al. | 62/56 |

* cited by examiner

ICE AND CHILLED WATER PRODUCING AND DISPENSING MACHINE

CROSS REFERENCE TO RELATED APPLICATION

This utility application claims the benefit of and priority to U.S. provisional application entitled, "Ice Machine Delivering Bagged Ice," having Ser. No. 61/424,416, filed Dec. 17, 2010, which is entirely incorporated herein by reference.

BACKGROUND

The production, bagging and sale of ice is an extremely large enterprise throughout the world. At present, the vast majority of pre-bagged ice is produced in a factory, bagged, and shipped frozen to commercial or retail establishments. Whether the ice is produced off-site and shipped to a retail site or bagged on-site and stored in bagged form, the ice is frozen and it could be days or even weeks old before a customer purchases the bag of ice. This can lead to ice that is stale and which may be exposed to environmental elements that can impart an odor to the ice during transport or subsequent storage. Another problem with pre-bagged ice that is stored in a frozen state is that any melting of the ice along the way results in the ice refreezing into large chunks of ice that have to be reduced in size prior to use. Typically, ice that has refrozen into large chunks in the bag is dropped onto a floor or countertop to shatter the ice chunks or chopped up using an ice pick, hammer, and like tools.

On-site ice producing machines are in wide use in facilities such as hotels and food service establishments. Such devices are typically large, floor standing units that may be capable of producing hundreds of pounds of ice per day. Ice produced in this manner is either dispensed by using a scoop to retrieve the ice from a storage bin or dispensed into an ice bucket or chest via a chute operated with push buttons on the front of the machine. This system requires that a container be provided, whether it be an ice bucket, ice chest, or plastic bag. Systems such as these can lead to potential contamination of the ice and/or water as human contact with the ice is increased with additional handling. Furthermore, there exist ice forms, such as pelletized ice, that are difficult or even impossible for known ice producing and bagging machines to be able to handle, due to factors such as the size of the pellets and their relatively fragile nature.

It is known to provide free standing ice bagging machines such as that shown in U.S. Patent Application Publication No. US 2004/0216481 A1 to James et al. This application discloses an ice bagging apparatus for automatically and continuously producing, bagging, and storing bags of ice. The device includes an ice maker, a hopper for receiving ice from the ice maker, a slider box for receiving ice from the hopper and for channeling the ice into a bag, a bagging mechanism, a freezer for storing the bagged ice, and a control panel for managing and monitoring the system. As the ice is produced and bagged, it is transferred to a freezer in the bottom portion of the machine where it is stored until withdrawn for use or sale. A similar device is shown by U.S. Patent Application Publication No. US 2007/0175235 A1 to Metzger, a co-inventor of the '481 application referenced above, the '235 application having many of the same features.

Other known devices include U.S. Pat. No. 5,088,300 to Wessa which discloses a machine that produces ice, bags the ice, and stores the ice in a freezer where it is stored prior to use and/or sale. Additional examples of stand alone ice makers are shown by U.S. Pat. No. 7,207,156 to Metzger; U.S. Pat. No. 7,624,773 to Maxwell; and U.S. Pat. No. 6,093,312 to Boulter.

Thus, while many solutions have been tried, there exists a need in the art for an ice production machine that is sanitary, energy efficient, and which solves some of the attendant problems found in prior art devices.

SUMMARY

Broadly stated, the present disclosure is concerned with a stand alone ice production apparatus which utilizes a commercially available ice maker which, in the disclosed embodiment, is capable of producing up to 2,000 pounds of ice per day. The ice is deposited by gravity into an insulated storage hopper having agitation means that periodically churn the stored ice to prevent bridging of the individual pieces. As the present device is meant to be used by consumers to purchase ice in small quantities, in bulk, or individual bags of ice, a vending function is supplied allowing the consumer to deposit bills, coins, credit cards, or other forms of payment into a payment accepting station. Upon payment, the apparatus delivers freshly produced ice to the consumer in any chosen amount, typically being dispensed in bags, into a small container such as a drinking cup, or into an ice chest or similar container holding between a few ounces or even less up to twenty-five pounds of ice or more.

When the customer inserts payment into the machine, the ice is conveyed from the storage bin through an auger/conveyor to the bag and measured by a level sensor to the quantity of ice that is desired to be purchased. The ice is typically deposited into a bag, which bag may be delivered either sealed or unsealed to the consumer, or the ice may be delivered into another container.

Water for the production of ice is introduced into a hermetically sealed capsule located within the apparatus. The capsule is located below the ice receiving hopper within an insulated but unrefrigerated holding bin. Inevitably with ice production, some melting of the ice occurs. In addition, ice will escape through a transition/hole in the bottom of the storage bin during operation of the machine. The cold water from the ice melting and any pieces of ice are directed to the storage bin which holds the fresh water capsule. This arrangement chills the water in the capsule prior to its delivery to the ice maker. Thus, instead of the ice maker receiving water at whatever ambient temperature happens to exist, the ice maker is supplied with chilled water from the capsule by virtue of the capsule being chilled by the byproducts of ice production. This greatly reduces the energy required to produce the ice as the ice maker only has to lower the temperature of the ice a few degrees in order for it to freeze.

In some embodiments, the present apparatus may also include a cold water dispensing station. In a similar manner in which chilled water is distributed to the ice maker, chilled water is dispensed to a consumer in quantities ranging from a few ounces to a gallon or more.

Additional objects and advantages of the present apparatus will become apparent to those skilled in the art from the following detailed description, accompanying drawings, photographs and claims.

DETAILED DESCRIPTION

Figure 1:
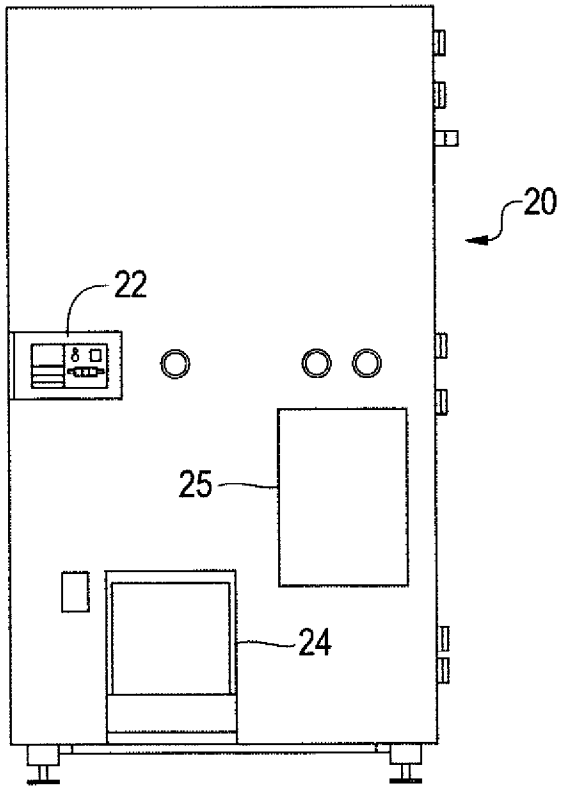
FIG. 1 is a front elevational view, showing a stand alone ice production and bagging apparatus showing the payment station and the ice dispensing door.

Referring more specifically to the drawings and to FIG. 1 in particular, numeral 20 designates generally a free standing ice production and bagging apparatus. The apparatus is meant to be placed virtually anywhere that has access to a water line and a power source whether electrical, solar, or other means for powering the apparatus. The apparatus is meant to be used by a consumer to purchase freshly bagged ice and, in some cases, chilled water that is ready for consumption. The apparatus includes a payment station 22 with means for accepting bills, coins, credit cards, and other forms of payment, as is known in the art. Once the ice is produced and bagged, it is delivered to the consumer through a door 24, located near the bottom of the apparatus. The ice can also be dispensed through a chute or the like (not shown) into a cup, ice chest, etc. The description to follow is concentrated on ice being produced and bagged prior to delivery to the consumer; however, the device is capable of producing and dispensing ice into another type of container and the description should be considered to include this type of delivery.

Figure 2:
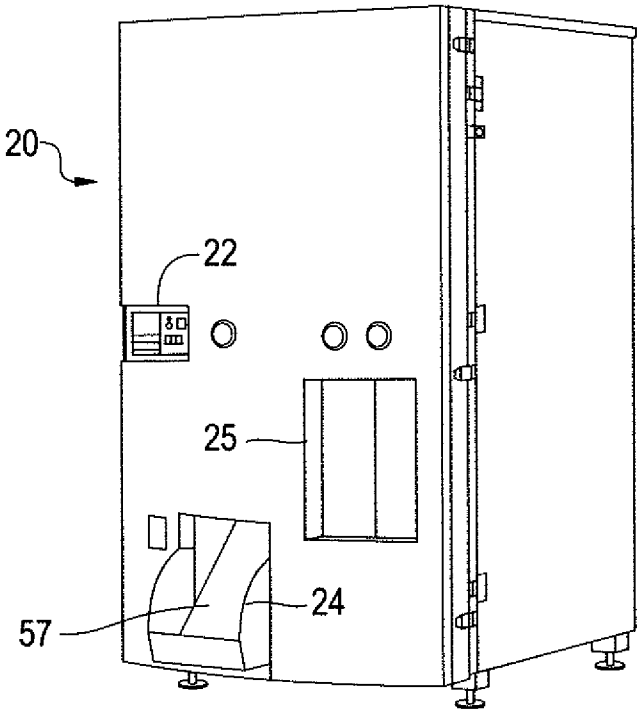
FIG. 2 is a perspective view of the present apparatus with a water dispensing station added.

FIG. 2 is a drawing of an embodiment of the present apparatus showing the payment station 22 and the ice delivery door 24. This embodiment also includes a water dispensing station 25, where a consumer can purchase chilled water in any of a number of different volumes, ranging from a few ounces to a gallon or more.

Referring to FIGS. 3-10, numeral 26 designates a commercially available ice maker of known design. The ice maker is capable of producing up to 2,000 pounds of ice a day, given optimum conditions. The amount of ice produced is controlled by limit switches that sense the amount of ice that is stored in the apparatus ready for delivery, the limit switches being operable to either activate or turn off the ice maker, as production warrants. Ice produced in the ice maker 26 is deposited via gravity into an insulated storage bin 28. The storage bin is capable, in this embodiment, of holding approximately 1,000 pounds of ice.

Figure 4:
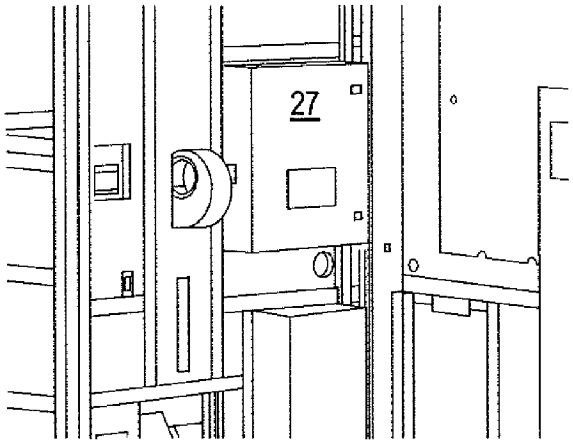
FIG. 4 is a partial perspective view showing the electronic control box.
Figure 5:
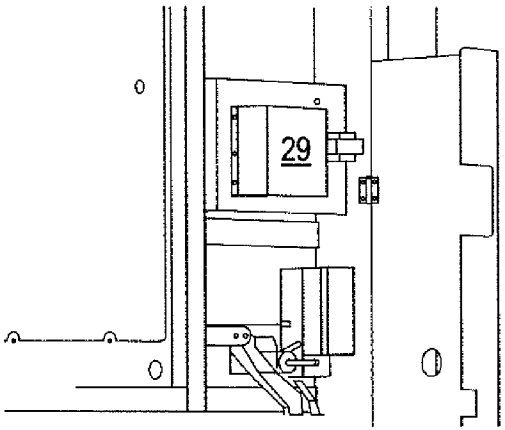
FIG. 5 is a partial front elevational view showing the modem used to communicate to and from the present apparatus.

FIG. 4 is a depiction of control means 27 that determine various factors and aspects of operation including, but not limited to, agitation of the ice cubes, timing of the various functions, limits on production, analysis of the operation, etc. FIG. 5 shows a modem 29 by which the machine owner or operator can control the operation of the machine from virtually any location using a computer, smart phone, or like device, utilizing an internet connection. The control means 27 monitors all aspects of operation and through the modem, is able to alert the operator to power failures, water shut-downs, the number of bags of ice produced and dispensed, the number of bags remaining, revenue received, the state of the water dispenser, etc. Thus, the operator can easily schedule regular maintenance visits, revenue collection, and other tasks, by virtue of the control and communications systems.

The control system has an auto-agitation feature. This is tied into the actual icemaker green board. It causes the machine/agitator to gain a personality based on past sales history. If it needs to agitate to fill the bin faster, it will, if not, it shuts down and goes to the predetermined default setting. The benefit of this is that the machine will fill the bin at the fastest possible rate without damaging the ice. In the past this has been a real issue that the owner/operator had to continuously monitor, so one didn't over agitate the ice, therefore causing mechanical damage or actually damaging the product to the point that it will not dispense. With this feature the owner/operator can literally walk away from the machine and it will manage its inventory by itself. The icemaker and the machine literally become one.

Located in the storage bin is an agitator shaft 30, from which project Multiple tines 32. The agitator shaft 30 is rotated using a motor 34, which may be coupled to the shaft using a direct drive, chain and sprocket drive, or the like. Periodic agitation of the ice contained in the storage bin is effected to keep the ice in a fluid state and to maintain the ice in a level orientation with respect to the storage bin. Maintaining the ice at a level orientation ensures that the storage bin 28 is maintained in a substantially full capacity, which in turn, provides several advantages that will be discussed hereinbelow. When a consumer inserts payment into the payment acceptor on the front of the present apparatus, a paddle wheel 36, located in an opening 35 below the storage bin 28, is activated. The paddle wheel 36 has a plurality of blade 37 and may be operated with a motor that is connected to auger/reducer 44, although other drive means may be utilized. The blades of the paddle wheel propel the ice down chute 38 to an upstanding, vertically oriented, and insulated tube 40. Inside tube 40 is a propelling means such as a vertically oriented auger 42 which is activated via motor 44, located therebelow. The auger drives the ice upwardly to a downwardly inclined receiving chute 47. The auger drives the ice into a funnel 48 from where it is directed into a waiting bag 50. In prior art designs, it has not been possible or even suggested that stored ice could be driven upwardly to a discharge chute. The present design solves this problem in an unexpected manner. By driving the ice vertically, the device can be configured in a more compact, space saving design, solving a long-felt need.

Figure 7:
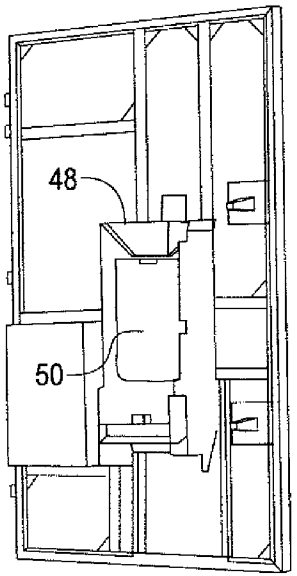
FIG. 7 is a partial perspective view showing the ice receiving hopper and bag storage station.
Figure 8:
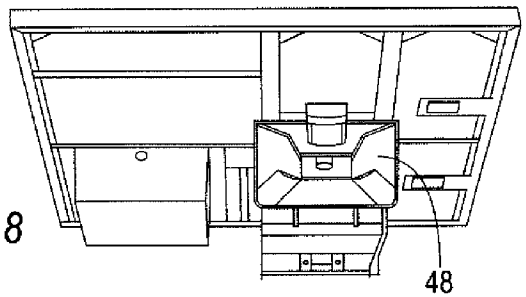
FIG. 8 is a partial top plan view looking down into the ice receiving hopper.
Figure 6:
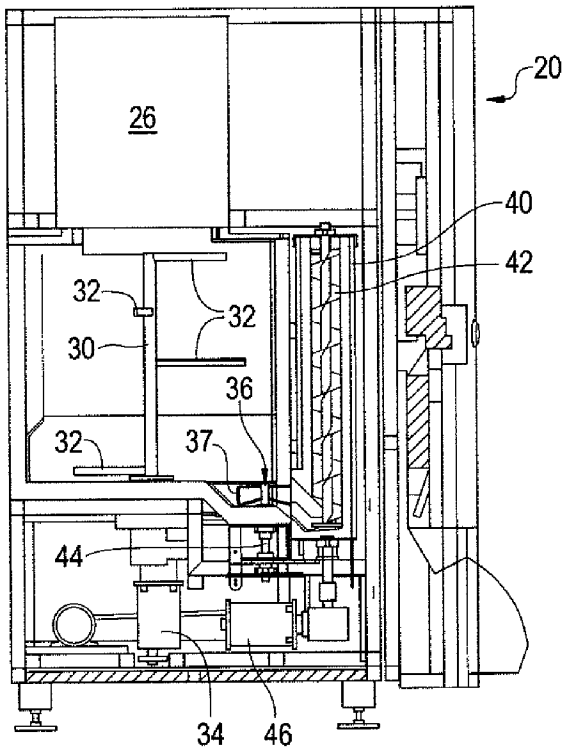
FIG. 6 is a side elevational view shown partially in cross-section, illustrating the means for delivering the ice from the hopper to a vertical auger for moving the ice to the bagging station.
Figure 10:
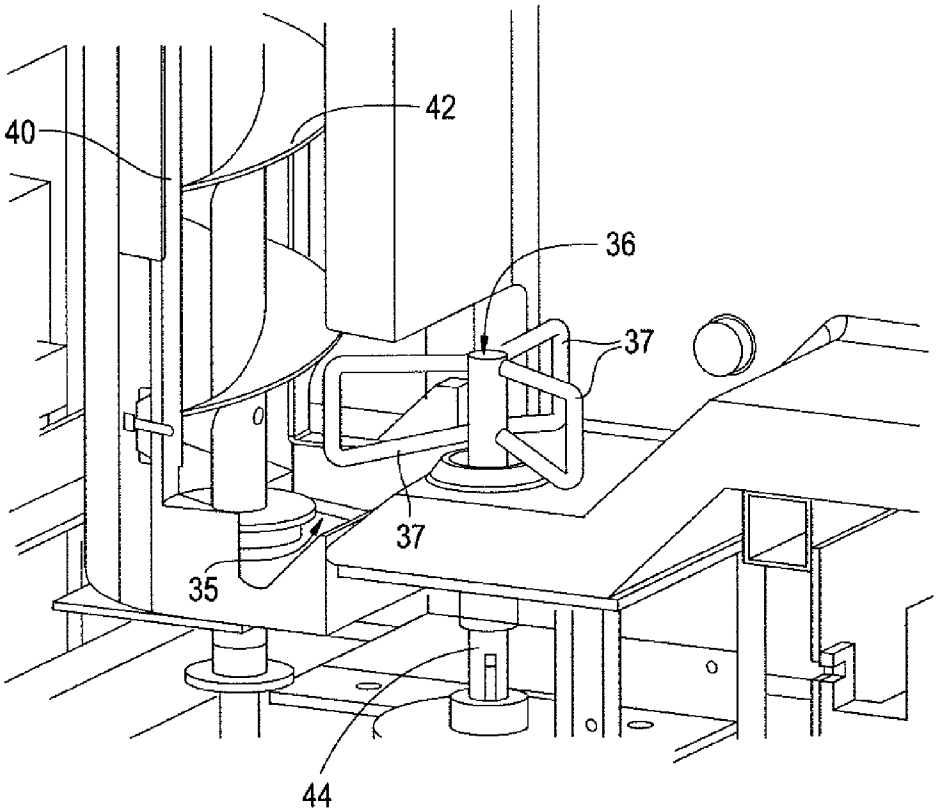
FIG. 10 is an enlarged partial cross-sectional view illustrating means for delivering the ice from the storage hopper to the auger.
Figure 9:
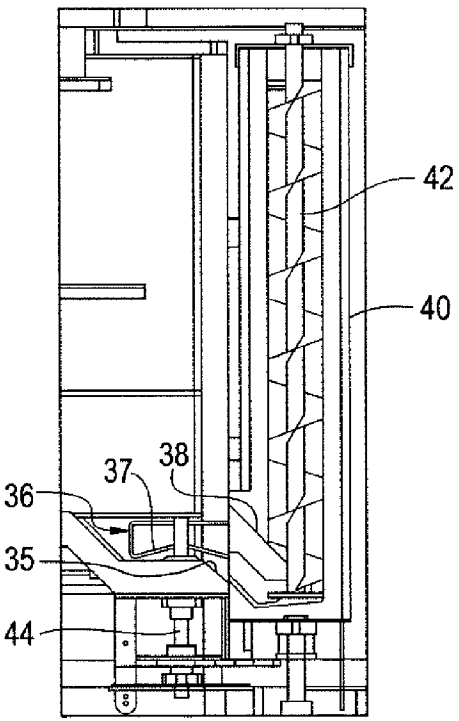
FIG. 9 is an enlarged partial cross-sectional view showing the vertical auger.

Funnel 48 is shown in drawing FIGS. 7 and 8. The funnel is mounted on the inside of the outer door and can be sized to any dimension within the confines of the available space. The funnel is used to transfer the ice from the auger tube to the bag. The amount of ice dispensed depends on the settings input by the operator and can be set to a desired level depending on the size of available bags, the amount of money inserted into the machine, and any other chosen parameters.

For example, the operator could provide bags capable of holding twenty pounds, and the consumer could choose to purchase five, ten, fifteen, or twenty pounds. As can be seen in FIGS. 7 and 8, the bags 50 are stored below the funnel 48. When a consumer inserts payment and the ice is driven into the funnel 48, a fan 51, (shown in FIG. 3), is activated and blows air into the bag, causing the mouth of the bag to open for receiving the ice cubes.

Figure 3:
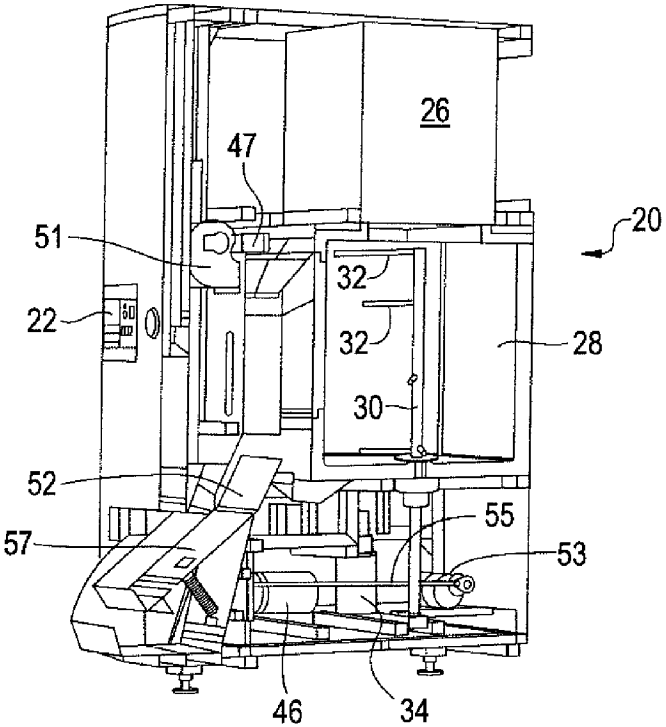
FIG. 3 is an isometric view shown partially in cross-section, showing the ice maker and storage bin and the associated motors.

The amount of ice deposited into the funnel 48 is controlled by limit switches which adjust the amount of ice dispensed depending on factors such as bag size, the amount of money deposited, and other factors controlled by the operator of the apparatus when it is initially set up for use. The filled bag of ice is then released onto a discharge chute 52 that leads to a hinged pad 57. The hinged pad pivots the bag forward to be sealed. When the filled bag of ice is deposited onto the inclined discharge chute, it may either activate a magnetic device to unlock the door and dispense the ice bag, or the bag may be directed via the hinged pad 57, by virtue of its weight, to a sealing pad where the bag is heat sealed or sealed in some other manner. The operation is controlled by motor 53 through a control arm 55 as shown in FIG. 3 or alternatively, by gravity. The sequencing is controlled using the electronic control means 27.

Figure 11:
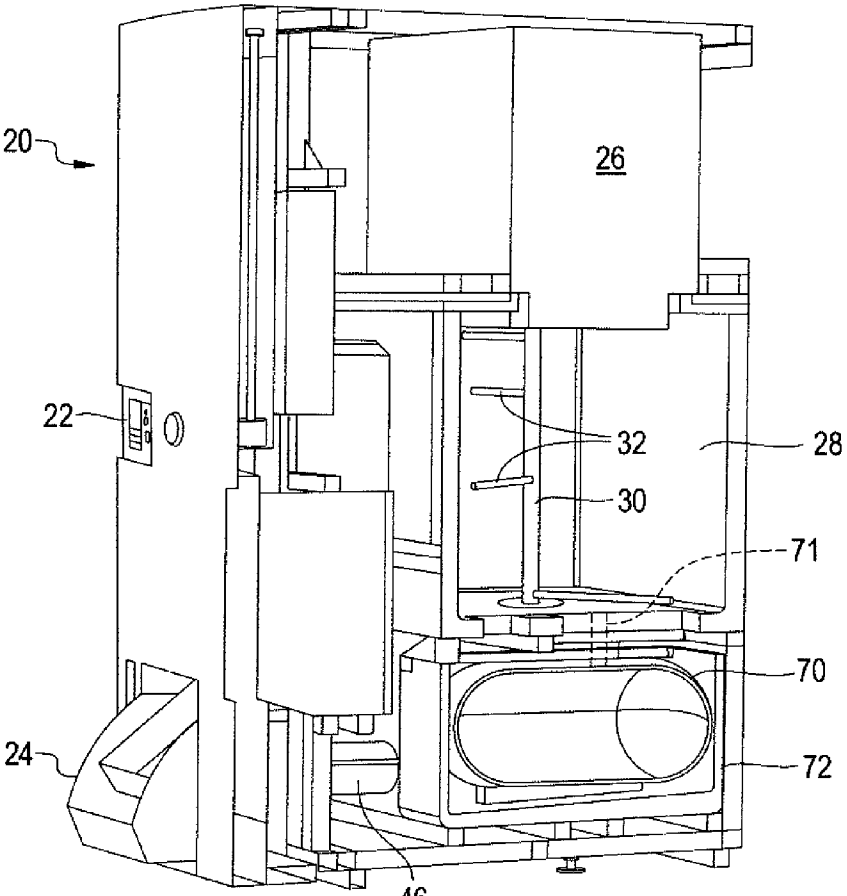
FIG. 11 is an isometric view shown with portions of the machine cut away, showing an alternate embodiment with a chilled water storage system.

Referring to FIG. 11, a water storage capsule 70 is shown located beneath the storage bin 28. Fresh water is introduced into the water storage capsule from an outside water line. The water entering the water storage capsule may be purified using filters, ultraviolet light, and/or other means, such that a supply of purified water is held in the capsule. Water from this capsule is then directed to the ice maker for use in ice production. The water storage capsule is located inside of an insulated housing 72. As ice is produced, there is inevitably some melting and pieces or chips of ice that escape the storage bin. The ice pieces, any melted ice, and any condensation which may be present is at a relatively low temperature. This chilled medium is directed via drains, passages 71 etc. into the insulated housing 72 where it contacts the outside of the water storage capsule 70. This arrangement serves to lower the temperature of the water in the water storage capsule, prior to its transfer to the ice maker 26. The delivery of chilled water to the ice maker greatly lowers the energy required to turn the chilled water into ice, thus resulting in substantial energy savings. As the present apparatus has no facility to refrigerate/freeze the ice that is produced by the ice maker, after its initial production, there is inevitably a byproduct in the form of chilled water. Thus an otherwise wasted resource is in effect recycled and used to cool the purified water in the water storage capsule. A suitable drain, not shown, is provided along with control means, to ensure the catch tank is not overfilled.

To amplify, the water capsule 70 and catch tank 72 are located under the primary ice storage bin to capture melting ice water and the crushed ice that is on the bottom. Since this is the waste being made from the primary product it is basically a "free" way to cool down the water that is being used to make the ice. When the water and crushed ice fall through the bottom of the bin into the catch tank 72, it partially surrounds the water capsule that is full of fresh incoming water and brings down the temperature of the incoming water that is going to the ice maker to approximately 35° to 40°. This makes the icemaker about 20% more efficient than it is by using normal incoming water that is 60° to 80° , and it is at no cost since it is using the byproduct of the melted ice. Secondly, the machine is dispensing the water that is cold out to the actual customer in any increment from as small as an ounce to multiple gallons, more or less. This is not being done anywhere because it is too expensive to chill the water before dispensing it. In the present case it costs nothing, because there is a constant supply of melting ice to always chill the water capsule. The present device can also be programmed to dispense a relatively small amount of ice into a cup and then dispense chilled water to fill the cup. The ability to fill small containers with chilled water further has the potential to limit the huge amounts of plastic water bottles that are annually discarded into landfills.

As discussed hereinabove, in an alternate embodiment, the present apparatus can be provided with one or more water dispensing stations 25, typically located on the front of the machine. When a consumer introduces payment into the payment acceptor to purchase water, chilled water is dispensed from the water storage capsule to a receptacle of virtually any size. No known system presently exists for such an efficient provision of purified chilled water in quantities that may range from a few ounces to a gallon or more.

Figure 12:
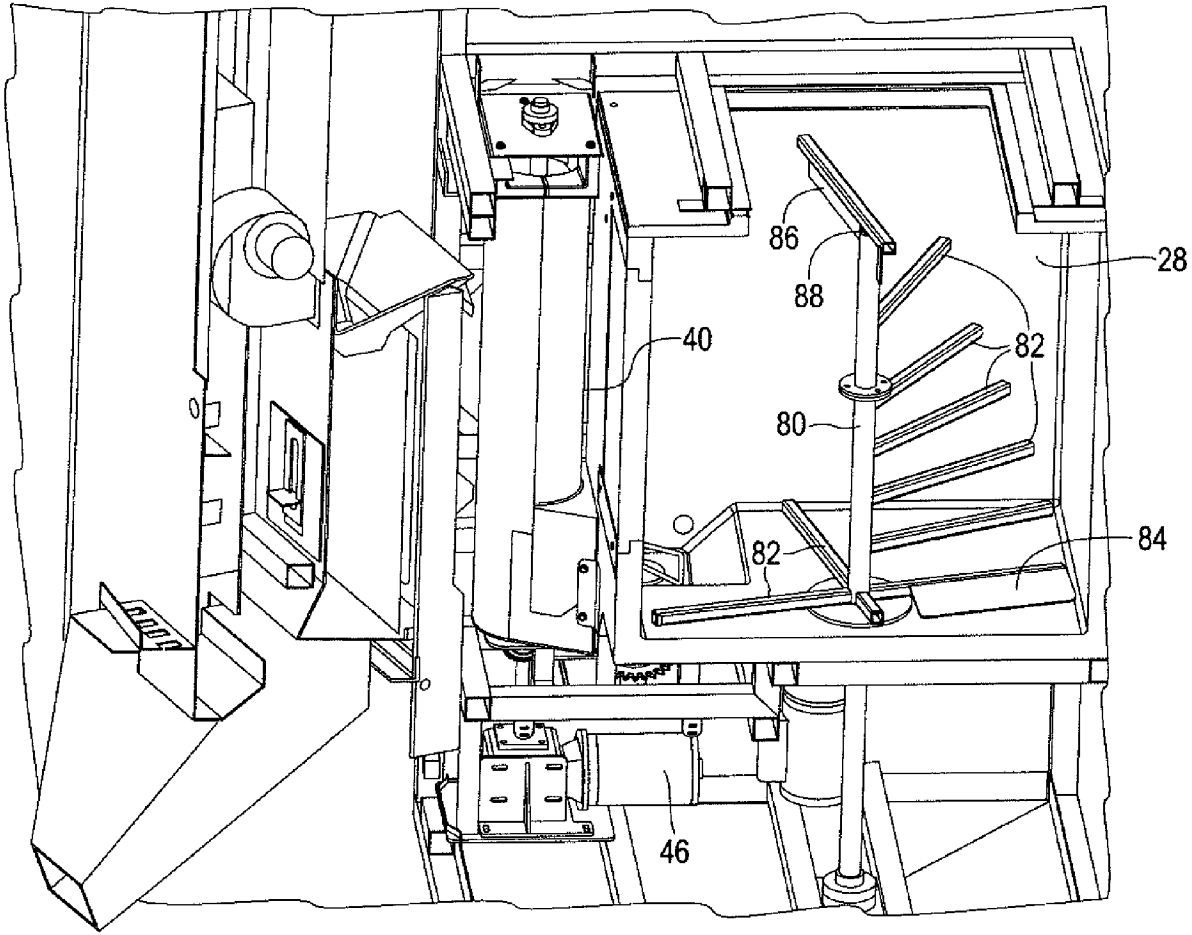
FIG. 12 is an isometric view, shown with portions of the machine cut away, showing an alternate version of an agitator for the ice storage bin.

An alternate embodiment in the form of a spiral staggered agitator is shown in FIG. 12. This agitator is particularly suited for pelletized or nugget ice, as opposed to cubes. Here the agitator has a central shaft 80 with a plurality of staggered and spirally arranged tines 82, projecting radially from the shaft 80. The lowermost tine has a wing-shaped extension or blade 84 that is disposed slightly above the bottom wall of the ice storage bin 28. The blade is angled slightly downwardly from a position parallel to the tine on which it is mounted. A similar extension or blade 86 is mounted on the uppermost tine, and disposed substantially perpendicular thereto. The top blade 86 serves to level the ice falling into the bin from the icemaker 26 that is located above the bin.

The lower blade and the spiral, staggered tines glide, or cut, through the stored ice in a very efficient manner. The design is able to handle pelletized ice, which has not been possible with any known prior art designs. A disk 88 is mounted on top of the agitator shaft 80 that has means, such as predrilled holes, to accommodate additional agitator tines if necessary or desired.

The present device also admits of an inventive method wherein water is introduced into the capsule 70 for use by the ice maker. Once ice production has begun, the by-products, i.e. ice chips, condensation, etc., are funneled to the insulated housing around the capsule. The water for the ice maker and for being dispensed as drinking water is pre-chilled prior to its introduction into the ice maker, thus conserving energy as detailed above.

Thus, while an embodiment of an ice production, bagging, and dispensing machine and modifications thereof have been shown and described in detail herein, various additional modifications may be made without departing from the scope of the present Invention or the appended claims.

The invention claimed is:

1. An ice producing and dispensing machine for delivering ice on demand to a consumer comprising:

a housing having an ice maker operationally disposed therein, said housing having an ice delivery outlet for delivering ice to consumers;

an ice storage bin disposed below said ice maker having an open top for receiving and storing ice from said ice maker and a bottom opening for discharging ice therefrom;

said ice storage bin having an agitator therein with a lower portion operationally connected to a motor for stirring the stored ice, said agitator having an axis of rotation and a tine with a downwardly angled blade disposed at said lower portion for urging the stored ice to said bottom opening, said blade disposed in a plane other then the plane defined by the tine and the axis of the agitator;

a vertical tube in communication with said bottom opening for receiving discharged ice and a propelling means in said tube for driving the ice into and upwardly in said tube; and a receiving chute in communication with said tube for conveying the ice to said ice delivery outlet.

2. The ice machine as defined in claim 1 in which said machine includes an ice bagging station in which a bag is disposed between said receiving chute and said ice delivery outlet for receiving the ice so that the consumer receives the ice in the bag.

3. The ice machine as defined in claim 1 in which said housing includes an insulated catch tank with a water storage capsule disposed in said catch tank below said ice bin, said capsule holding water for use by the ice maker, said insulated catch tank positioned below said ice storage bin and having at least one drain to receive any ice particles and melted water from the ice production and chilling the water in said capsule to hasten ice formation in the ice maker.

4. The ice maker as defined in claim 1 in which said agitator has a shaft with a plurality of staggered tines projecting radially from said shaft for assisting in stirring the stored ice.

5. The ice machaine as defined in claim 1 and including a water dispensing station.

6. The ice machine as defined in claim 1 in which said housing includes an insulated catch tank with a water storage capsule disposed therein below said ice bin, said capsule holding water for use by the ice maker, said insulated catch tank positioned to receive any ice particles and melted water from the ice production and chilling the water in said capsule.

7. The ice machine as defined in claim 6 in which said water dispensing station is connected to said capsule for receiving chilled water to dispense.

8. An ice and chilled water producing and dispensing machine for delivering ice and chilled water on demand to a consumer comprising:

a housing having an ice maker operationally disposed therein for producing ice to be dispensed to a consumer, and an ice delivery outlet from which the consumer obtains the dispensed ice;

an ice storage bin disposed below said ice maker having an open top for receiving and storing ice from said ice maker and a bottom opening for discharging ice therefrom;

said ice storage bin having an agitator therein with a lower portion operationally connected to a motor for stirring the stored ice, said agitator having an axis of rotation and a tine with a blade attached thereto, said blade being disposed at said lower portion for urging the stored ice to said bottom opening, and disposed in a plane other than the plane defined by said tine and said axis of rotation a vertical tube in communication with said bottom opening for receiving discharged ice and a propelling means in said tube for driving the ice upwardly in said tube;

a receiving chute connected to said tube for conveying the ice to said ice delivery outlet; and a water dispensing station operationally disposed in said housing for dispensing water to a consumer.

9. The ice and chilled water producing and dispensing machine as defined in claim 8 in which said machine includes an ice bagging station in which a bag is disposed between said discharge opening and said ice delivery outlet for receiving the ice so that the consumer recives the ice in the bag.

10. The ice and chilled water producing and dispensing as defined in claim 8 in which said agitator has a shaft with a plurality of staggered tines projecting radially for assisting in stirring the stored ice.

11. The ice and chilled water producing and dispensing machine as defined in claim 8 in which said housing includes an insulated catch tank with a water storage capsule disposed in said catch tank and below said ice bin, said capsule holding water for use by the ice maker, said insulated catch tank having at least one drain and positioned to receive any ice particles and melted water from the ice production, for chilling the water in said capsule.

12. The ice and chilled water producing and dispensing machine as defined in claim 11 in which said water dispensing station is connected to said capsule for receiving chilled water to dispense.

* * * * *